US006803565B2

(12) United States Patent
Smith et al.

(10) Patent No.: US 6,803,565 B2
(45) Date of Patent: Oct. 12, 2004

(54) IONIZATION SOURCE UTILIZING A MULTI-CAPILLARY INLET AND METHOD OF OPERATION

(75) Inventors: Richard D. Smith, Richland, WA (US); Taeman Kim, Richland, WA (US); Harold R. Udseth, Richland, WA (US)

(73) Assignee: Battelle Memorial Institute, Richland, WA (US)

( * ) Notice: Subject to any disclaimer, the term of this patent is extended or adjusted under 35 U.S.C. 154(b) by 236 days.

(21) Appl. No.: 09/860,727

(22) Filed: May 18, 2001

(65) Prior Publication Data

US 2002/0185595 A1 Dec. 12, 2002

(51) Int. Cl.[7] ..... H01J 49/04; H01J 49/42

(52) U.S. Cl. ..... 250/288; 250/281; 250/282; 250/396 R; 250/292

(58) Field of Search ..... 250/281, 282, 250/288, 292, 396 R

(56) References Cited

U.S. PATENT DOCUMENTS 5,652,427 A * 7/1997 Whitehouse et al. ..... 250/288
5,962,851 A * 10/1999 Whitehouse et al. ..... 250/288
6,066,848 A * 5/2000 Kassel et al. ..... 250/288
6,107,628 A * 8/2000 Smith et al. ..... 250/292
6,121,607 A * 9/2000 Whitehouse et al. ..... 250/288
6,188,066 B1 * 2/2001 Whitehouse et al. ..... 250/288
6,403,953 B2 * 6/2002 Whitehouse et al. ..... 250/288
6,410,915 B1 * 6/2002 Bateman et al. ..... 250/288
6,583,408 B2 * 6/2003 Smith et al. ..... 250/288
2001/0032930 A1 * 10/2001 Gillig et al. ..... 250/288
2001/0038069 A1 * 11/2001 Whitehouse et al. ..... 250/288
2002/0121596 A1 * 9/2002 Laiko et al. ..... 250/288
2002/0121598 A1 * 9/2002 Park ..... 250/288
2002/0185595 A1 * 12/2002 Smith et al. ..... 250/288
2002/0185606 A1 * 12/2002 Smith et al. ..... 250/423 R
2003/0034451 A1 * 2/2003 Whitehouse et al. ..... 250/288

FOREIGN PATENT DOCUMENTS

EP 0258016 A1 * 3/1988 ..... B05B/5/08
WO WO 99/38193 * 7/1999 ..... H01J/49/04

* cited by examiner

*Primary Examiner*—John R. Lee
*Assistant Examiner*—Bernard Souw
(74) *Attorney, Agent, or Firm*—Douglas E. McKinley, Jr.

(57) ABSTRACT

A multi-capillary inlet to focus ions and other charged particles generated at or near atmospheric pressure into a relatively low pressure region, which allows increased conductance of ions and other charged particles. The multi-capillary inlet is juxtaposed between an ion source and the interior of an instrument maintained at near atmospheric pressure, it finds particular advantages when deployed to improve the ion transmission between an electrospray ionization source and the first vacuum stage of a mass spectrometer, and finds its greatest advantages when deployed in conjunction with an electrodynamic (RF) ion funnel deployed within the interior of the mass spectrometer, particularly an ion funnel equipped with a jet disturber.

18 Claims, 4 Drawing Sheets

IONIZATION SOURCE UTILIZING A MULTI-CAPILLARY INLET AND METHOD OF OPERATION

STATEMENT REGARDING FEDERALLY SPONSORED RESEARCH OR DEVELOPMENT

This invention was made with Government support under Contract DE-AC06-76RLO 1830 awarded by the U.S. Department of Energy. The Government has certain rights in the invention.

CROSS REFERENCE TO RELATED APPLICATIONS

Not Applicable

FIELD OF THE INVENTION

The present invention relates generally to a method and apparatus for directing or focusing dispersed charged particles into a low pressure apparatus. More specifically, the invention utilizes a multi-capillary inlet to increase the conductance of ions and other charged particles generated at or near atmospheric pressure into a relatively low pressure region, which allows increased efficiency in transmitting those ions and other charged particles.

BACKGROUND OF THE INVENTION

A great variety of scientific inquiry is confronted with the challenge of identifying the atomic structure or composition of particular substances. To assist in this identification, a variety of schemes have arisen which require the ionization of the particular substances of interest. Many of these analytical techniques, as well as the other industrial uses of charged particles, are carried out under conditions of high vacuum. However, many ion sources operate at or near atmospheric pressures. Thus, those skilled in the art are continually confronted with challenges associated with transporting ions and other charged particles generated at atmospheric or near atmospheric pressures into regions maintained under high vacuum.

An illustrative example of this general problem is presented in the use of electrospray ionization when combined with mass spectrometry as an analytical technique. Electrospray ion sources (which broadly includes, but is not limited to, nano electrosprays, conventional electrosprays, microelectrospray, and nebulizing gas assisted electrospray) are widely used with mass spectrometry for sample analysis, for example in biological research. For m/z analysis, ions are typically created at atmospheric pressure by the electrospray ion source and are then transported to the high vacuum region of a mass spectrometer through a capillary inlet that penetrates the first chamber of the mass spectrometer. A differential pumping system involving several stages for stepwise pressure reduction is commonly used to achieve the vacuum conditions conventionally utilized in m/z analysis within the mass spectrometer, and the major design issues are generally related to optimizing overall ion transmission efficiencies.

Improved transmission efficiencies in the intermediate vacuum stages have been achieved by using the recently developed RF ion funnel at higher interface pressures (~1 to 10 Torr) and RF multi-pole ion guides with buffer gas cooling at lower interface pressures as more fully described in Shaffer, S. A.; Tang, K.; Anderson, G. A.; Prior, D. C.; Udseth, H. R.; Smith, R. D., *Rapid Commun. Mass Spectrom.* 1997, 11, 1813–1817; Shaffer, S. A.; Prior, D. C.; Anderson, G. A.; Udseth, H. R. and Smith, R. D. *Anal. Chem.* 1998, 70, 4111–4119; and Douglas, D. J.; French, J. B., *J. Am. Soc. Mass Spectrom.* 1992, 3, 398–408, and U.S. Pat. No. 6,107,628 entitled Method and Apparatus for Directing Ions and other Charged Particles Generated at Near Atmospheric Pressures into a Region under Vacuum, the entire contents of each of which are herein incorporated into this specification by this reference.

However, in the region where the ions of interest are generated, the total charge transmission is directly proportional to the cross section area of the inlet orifice diameter or capillary inner diameter. To improve the ion transmission in this region, a larger inlet is clearly desired, but the inlet size is limited by several factors. For example, simply using a larger inside diameter (I.D.) capillary inlet is problematic. First, the desolvation is less effective for larger I.D. capillary inlets because of the greater temperature variation across the capillary radius (resulting in a large variation in droplet desolvation efficiency). A second problem is the ion transmission efficiency in the first vacuum stage may be decreased due to greater gas dynamic effects. Thus, there is still a general need for improved methods for generating ions at atmospheric pressures, and a particular need for an efficient ion transmission while maintaining the effective droplet desolvation for the ion currents relevant to electrospray ionization (ESI) where aerodynamic effects dominate. Ion transmission between an ion source and the first vacuum stage is primarily dependent upon the proximity and gas conductance of the interface inlet.

SUMMARY OF THE INVENTION

Accordingly, it is an object of the invention in one of its aspects to provide a method for providing an ion or charged particle source in a pressure region at near atmospheric pressures. As used herein, "near atmospheric" pressures are defined as between $10^{-1}$ millibar and 1 bar. Also as used herein, the charged particles are defined as being smaller than one billion AMUs. The focusing of the present invention is accomplished by providing an apparatus, hereinafter referred to as a "multi-capillary inlet", which is operated at the interface between an ESI source and the interior of an instrument maintained at near atmospheric pressures. To demonstrate a preferred embodiment of the present invention, a prototype multi-capillary inlet was constructed from an array of seven thin wall stainless steel tubes soldered into a central hole of a cylindrical heating block. However, those skilled in the art will recognize that the advantages of the present invention may be achieved by providing a plurality of narrow passageways or orifices through which a flow of charged particles may be directed, regardless of the particular method of fabrication. While interfaces formed of capillaries as described herein are the preferred method of fabrication, interfaces having essentially equivalent physical dimensions can be fabricated by a variety of means well known to those having skill in the art, and the use of the term "multi-capillary" should not, therefore, be construed to limit the scope of the invention. Rather, the present invention should be construed as including any apparatus whereby a plurality of passageways are formed as the interface between an ion source, such as an ESI, and the interior of an instrument maintained at near atmospheric pressure. These would include, but not limited to, an interface formed by drilling a plurality of passageways into a block of material, an interface formed by casting a block of material with passageways formed in a casting process or molding process, and an interface formed by providing an array of capillaries as described in the description of the preferred embodiment herein.

"While the present invention should be broadly construed to include any application wherein the multi-capillary inlet is desired juxtaposed between an ion source and the interior of an instrument maintained at near atmospheric pressure, it finds particular advantages when deployed to improve the ion transmission between an ESI source and the first vacuum stage of a mass spectrometer, and finds its greatest advantages when deployed in conjunction with an electrodynamic (RE) ion funnel deployed within the interior of the mass spectrometer. When deployed in this fashion, the multi-capillary inlet described herein has been demonstrated to provide more uniform droplet evaporation conditions than are provided by a single capillary having the same gas conductance. The present invention is further advantageously deployed with an ion funnel equipped with a jet disturber, as described in U.S. Pat. No. 6,583,408, filed May 18, 2001, "Improved Ionization Source Utilizing a Jet Disturber in Combination with an Ion Funnel and Method of Operation" the entire contents of which are incorporated herein by this reference."

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DESCRIPTION OF THE PREFERRED EMBODIMENT(S)

To demonstrate a preferred embodiment of the present invention a multi-capillary inlet interface was designed for operation with an electrodynamic (RF) ion funnel. The experiments were conducted using an API 3000 triple quadrupole mass spectrometer system (SCIEX, Concord, ON).

Figure 1:
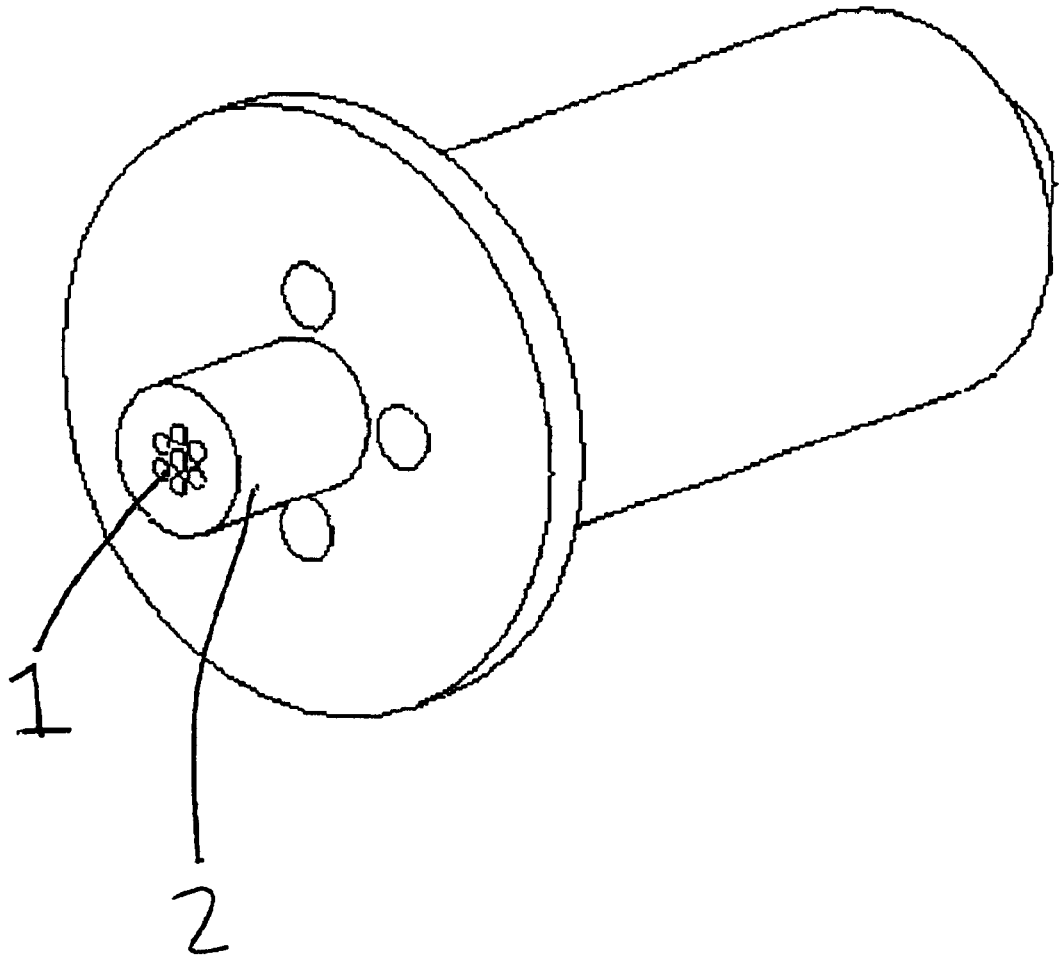
FIG. 1 is a schematic diagram of a preferred embodiment of the present invention.

A heated multi-capillary inlet was designed and fabricated by silver soldering seven 76 mm long stainless steel tubes (Small Parts Inc., Miami Lakes, Fla.) into a hole of a cylindrical stainless steel heating block. Two different capillary diameters were evaluated (0.51 mm I.D., 0.71 mm O.D. or 0.43 mm I.D., 0.64 mm O.D.). A schematic of the seven capillary inlet is shown in FIG. 1. The same diameter was used for all seven tubes 1 resulting in inlets whose theoretical conductance differs by factor of 7 compared to a single capillary of the same dimension. To maintain constant temperature on the inner surfaces of the capillaries, the interstitial space was filled with silver solder. A single 0.51 mm I.D., 76 mm capillary inlet of similar design was also constructed and used as a reference inlet. The stainless steel block 2 was heated by a 60 W cartridge heater (Ogden, Arlington Heights, Ill.) and the temperature monitored by a thermocouple. For these experiments, a controller maintained the temperature of the block at ~200° C., however, as will be recognized by those having skill in the art, the heating block may be advantageously maintained at temperatures between about 100° and 350°.

An ion funnel conceptually similar to the RF ring electrode ion beam guide, but further incorporating an additional DC potential gradient and electrodes of varying diameter (decreasing "down" the funnel) was also utilized in these experiments. The funnel interface had two major parts; (a) a front section of the funnel that consists of fifty-five 25.4 mm I.D. rings and (b) a rear section with forty-five ring electrodes with diameters linearly decreasing from 25.4 to 2.3 mm. The front section reduces the gas dynamic effects upon ion confinement, allows improved conductance for pumping, reducing the gas-load to downstream of the ion funnel and providing an extended ion residence time to enhance desolvation of charged clusters or droplets. RF voltages of equal but opposite phases were applied between adjacent rings and gradually decreasing DC potentials were applied along the lens stack. The oscillating RF fields near the ring electrodes served to push ions to the weaker electric field region, the central axis region of the ring electrodes. Concurrently, a low DC electric field pushed the ions towards the electrodes having progressively smaller apertures (i.e. the bottom of the ion funnel) while buffer gas collisions thermalize the ion kinetic energy (i.e. collisionally damped the motion of the ions).

Figure 2:
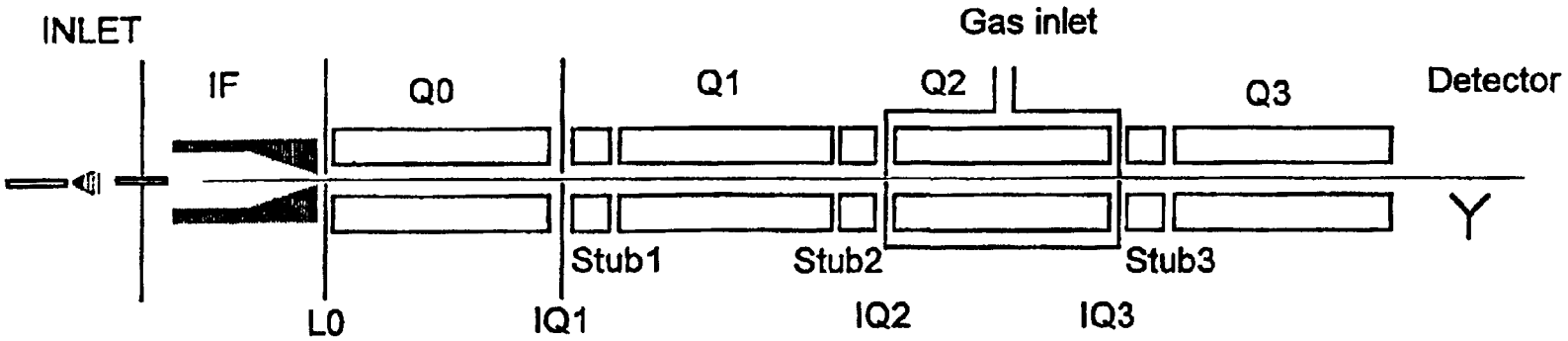
FIG. 2 is a schematic diagram of the quadrupole instrument used to demonstrate the preferred embodiment of the present invention.

"As shown in the schematic of FIG. 2, in the operation of the multi-capillary inlet, the first vacuum stage was pumped by two roots blowers providing nominal pumping speeds of 168 L/sec (Model EH500A system, EDWARDS, Crawley, West Sussex, England) and 84 L/sec (Model WSU251 system, Leybold, Koln, Germany). The pressure in the first vacuum stage was monitored by a Model CMLA-11-001 capacitance manometer (Varian, Lexington, Mass.). In some experiments, the pressure of the first vacuum stage was adjusted by partly closing butterfly valves installed between the ion funnel chamber and the roots pumps. The ion funnel (labeled "IF" in FIG. 2) was generally operated at a pressure similar to that of the first vacuum stage of the standard API 3000 ESI interface (i.e. about 1 Torr). The multi-capillary inlet, however, actually resulted in a greater-down stream pressure. Even though conductance of the last ring electrode (2.3 mm I.D.) of ion funnel was smaller than that of the 2.6 mm I.D. skimmer of the standard interface, it was evident that a more intense gas jet formed by the multi-capillary inlet compared to the standard inlet aperture for the API 3000, and implying that the effective pressure in the ion funnel is higher than the ~1 Torr indicated above.

The incoming ion current to the ion funnel from the heated capillary inlet was measured by summing the currents to the ion funnel, the DC lens after ion funnel, the collisional cooling quadrupole ion guide (Q0) and a conductance limit after Q0 (IQ1). The ion funnel transmitted current was measured by measuring the electric current to Q0 and a conductance limit after Q0 (IQ1). (During the current measurements, the down stream components were biased to +20 V.) To determine the transmission efficiency through the analyzing quadrupole (Q1), the ion current was measured before and after Q1. The ion current before Q1 was evaluated by measuring the current on lens IQ1 with down stream elements biased to +60 V. The ion current after Q1 was similarly measured on IQ2. Typical bias potentials are given in Table 1.

TABLE 1

The bias potentials of the ion optical element used for performance evaluation.

| Component | Bias (V) |
|---|---|
| Capillary inlet | +120 to +360 |
| Front ion funnel | +120 to +360 |
| Bottom ion funnel | +28 |
| L0 | +24 |
| Q0 | +20 |
| IQ1 | +12 |
| Stub1 | +10 |
| Q1 | +15 |
| Stub2 | +10 |
| IQ2 | 0 |
| Q2 | −20 |
| IQ3 | −40 |
| Stub3 | −60 |
| Q3 | −80 |

The standard ion inlet of the API 3000 mass spectrometry was used for the transmitted current measurements. In experiments with the standard inlet, the electrospray emitter (i.e., ion source) was tilted by 45 degrees, as in the standard operational configuration for the API 3000. In experiments with the heated capillary inlet, the electrospray emitter was evaluated in both 45 degree tilted and conventionally aligned configurations. The ion transmission was similar in both configurations after optimization, but the aligned configuration was adapted in this study with the capillary inlet due to its greater ease of optimization.

Figure 3:
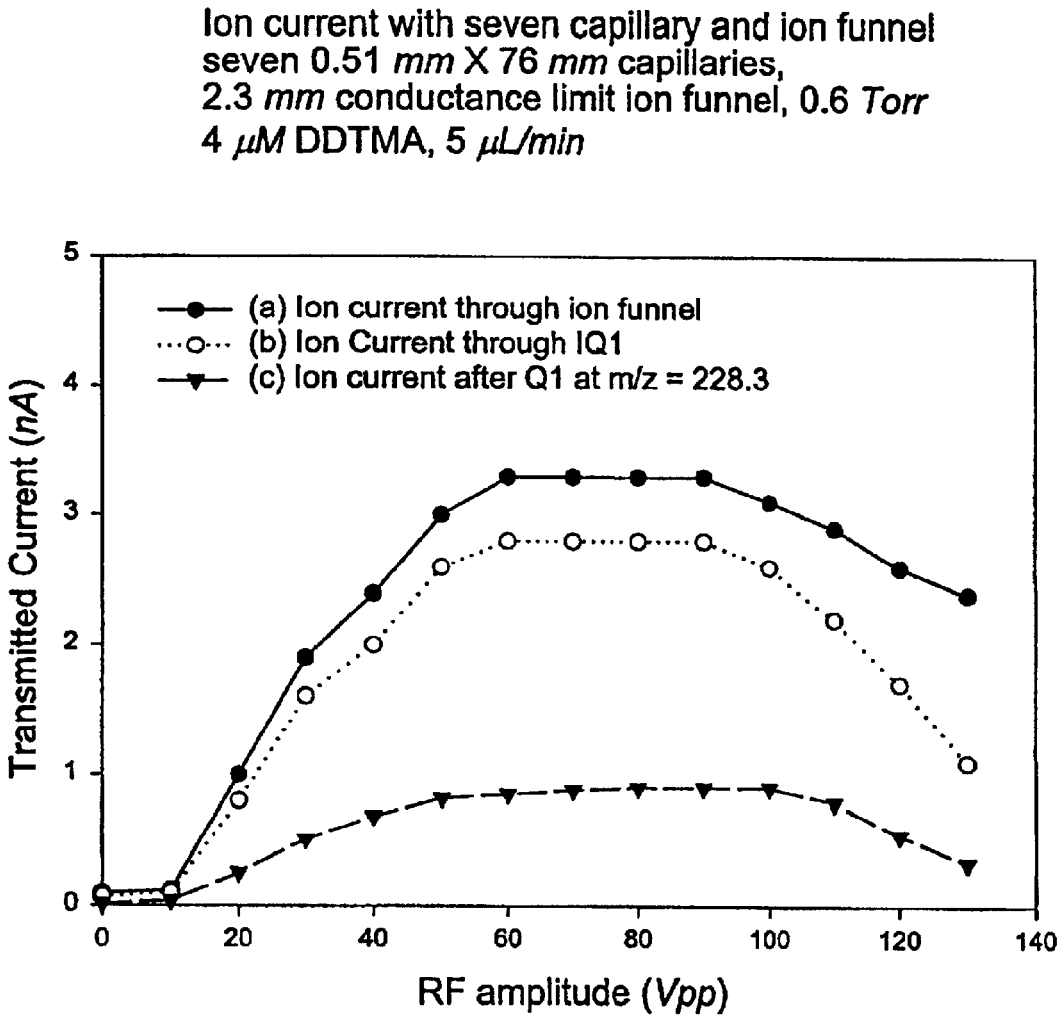
FIG. 3 is a graph of the ion currents measured through the ion funnel using the 0.51 mm I.D. seven capillary inlet design (closed circles), the ion current through a inter-quadrupole lens (IQ1, located between Q0 and Q1) (open circles), and the ion current after the analyzing quadrupole (reversed triangles) as functions of ion funnel RF amplitude. The inlet ion current was 5.4±0.2 nA.

The position of the emitter tip and the nebulizing gas flow rate were adjusted to optimize the ion current after the ion funnel. Dodecyltrimethylammoniumbromide (DDTMA, $C_{15}H_{34}NBr$) in acetonitrile was used to evaluate ion funnel transmission at relatively low m/z. The DDTMA was purchased from Sigma (St. Louis, Mo.) and the acetonitrile was purchased from Aldrich (Milwaukee, Wis.), and were used without further purification. The potential applied to the electrospray emitter was 4500–5500 V. The measurement of ion currents after m/z-analysis largely assures that the transmitted ion current from an ESI source arises from analytically useful charged species, and this gives increased confidence in performance evaluation. FIG. 3 gives the ion currents measured through the ion funnel using the 0.51 mm I.D. seven capillary inlet design (closed circles), the ion current through an inter-quadrupole lens (IQ1, located between Q0 and Q1) (open circles), and the ion current after the analyzing quadrupole (reversed triangles) as functions of ion funnel RF amplitude. The inlet ion current was 5.4±0.2 nA. The results show that the ion transmission through ion funnel increases with increasing RF amplitude to a level where over 60% of the inlet current is transmitted, and then decreases with further RF amplitude increases. That observed transmission trend is typical for an RF ion guide; at first the ion transmission increases with increasing RF amplitude due to the increased pseudo-potential of the trapping field, and is followed at some point by a decrease with further RF amplitude increase due to the unstable trajectories or RF driven fragmentation of lower m/z ions. The results also clearly show that the transmitted ion current at zero RF amplitude is well below that realized at optimal RF amplitudes (i.e. at 60–100 V), demonstrating that the ion transmission through the ion funnel is a result of ion confinement due to the RF electric field. As a result, the ratio of transmitted ion current to the neutral gas transmission is higher than in a conventional (e.g. orifice-skimmer or capillary-skimmer) interface. In the conventional, orifice (or capillary)—DC focusing lens—skimmer interface, the distance between the inlet and the skimmer is few mm and a much larger fraction of the orifice-passed gas can enter to the second chamber through the skimmer.

It is of particular importance to note that the maximum ion transmission efficiency was similar to that obtained with a single same I.D. capillary inlet, but with a higher ion current. The high transmission efficiency with the multi-capillary—ion funnel interface can be explained by two factors. The multiple capillary design provides droplet desolvation that is similar to that for a single capillary inlet of the same I.D. This is in contrast to the poor transmission efficiency observed for a single capillary of larger I.D. of a given length where the effective heated surface to volume ratio is reduced and desolvation is less efficient. This improved performance may also be attributed to a reduced gas dynamics effect. Instead of a larger expanding gas jet of a single larger I.D. inlet, the down-stream gas dynamics of the multi-capillary inlet will produce a complex pattern of jets that might be expected to interact destructively, and lead to a reduced gas dynamics effect. While the latter is speculative at this point, the data clearly shows a substantial improvement in the analytically useful ion current transmitted through the ion funnel.

Ion Transmission Comparisons with Standard Interface

The ion transmission for various multi-capillary configurations was compared with that for the standard interface of the API 3000 as shown in Table 2.

TABLE 2

Sensitivity gain using jet disturber equipped ion funnel for high concentration samples.

| | M/z | Enhancement[a] Seven capillary[b] |
|---|---|---|
| 5-FU | 129.0 | 8.8 |
| 500 pg/ul | 41.8* | 10.7 |
| Minoxidil | 210 | 5.2 |
| 100 pg/ul | 193* | 5.3 |
| Taurocholic | 514 | 5.9 |
| 500 pg/ul | 80* | 7.8 |
| Reserpine | 609 | 6.8 |
| 100 pg/ul | 195* | 6.6 |

[a]compared to the spectrum with Sciex API 3000 standard interface, 0.25 mm orifice.
[b]Seven 0.43X75 mm capillary, mechanical pump (D65B, 22 L/sec), ion funnel chamber pressure: 2.5 Torr, Q0 chamber pressure: 4.1 mTorr
*a major peak of MS/MS It should be noted that while the present design with a single 0.51 mm I.D. 76 mm long capillary—ion funnel interface could transmit ion currents similar to that of the standard API 3000 orifice-skimmer interface, the heated capillary—ion funnel interface provided a greater ion current to IQ1. The standard orifice-skimmer interface has no significant differences in transmission for these low mass ions that have unstable trajectories in the RF-only quadrupole (Q0). Therefore, the present single capillary inlet-ion funnel interface provided about two times higher transmission efficiency than the standard interface for analyte related ions which can be attributed to the improved droplet desolvation and ion collection of the heated capillary-ion funnel configuration. The inlet transmitted current with seven 0.51 mm I.D. capillary inlet was more than seven times larger than that for a 0.51 mm I.D. capillary inlet. That higher transmission efficiency for the seven capillary inlet may be explained by the ion distribution, and the collective gas dynamic effects at the entrances of closely packed capillaries. The ion distribution at the entrance of the seven capillary inlet may vary due to space charge effects, and the gas flow at the entrance region of the multi-capillary inlet may be different significantly from the single inlet design. Table 2 also shows that a 0.51 mm I.D. seven capillary inlet provides a greater ion transmission efficiency than of a 0.43 mm I.D. seven capillary inlet, but that the transmission efficiency is not proportional to the conductance increase. The gas conductance of 0.51 mm I.D. capillary is about two times of that of 0.43 mm I.D. capillary, but the transmitted ion current for the 0.51 mm I.D. seven capillary was only 13% higher than that with 0.43 mm I.D. seven capillary inlet. The lower ion transmission gain with the 0.51 mm I.D. seven capillary inlet compared to the increased gas conductance may also be attributed to gas dynamic effects. Most importantly, Table 2 also shows that an interface with a multiple capillary inlet and ion funnel has about 23 times higher current to high vacuum stage (after Q0) compared to the standard orifice-skimmer interface.

Ion Detection Efficiency

Ion detection efficiency was evaluated with a 0.51 mm I.D. seven capillary inlet by monitoring ion current after the analyzing quadrupole. The resolution of analyzing quadrupole was tuned to achieve unit mass resolution. FIG. 3 gives the ion currents measured before and after the analyzing quadrupole with the analyzing quadrupole set at m/z=228.3. The ion transmission efficiency through IQ1 was about 90%. FIG. 3 shows about 30% transmission through the analyzing quadrupole and that the analyzing quadrupole transmitted current is approximately proportional to the ion current measured before the analyzing quadrupole. The analyzing quadrupole transmitted current of second isotopic peak (m/z=229.3) was also measured as 17% of the major isotopic peak (m/z=228.3) current, as expected.

Table 3 gives the sensitivity gain for different capillary inlets compared to the standard API3000 interface with 10 times diluted samples as used for Table 2 w experiment to eliminate the possible detector saturation. In these experiments, the ion funnel was equipped with a jet disturber as described in co-pending U.S. patent application Ser. No. 09/860,721, filed May 18, 2001, "Improved Ionization Source Utilizing a Jet Disturber in Combination with an Ion Funnel and Method of Operation", the entire contents of which are incorporated herein by this reference.

TABLE 3

Sensitivity gain using jet disturber equipped ion funnel for low concentration samples.

| | M/z | Enhancement[a] Seven capillary[b] |
|---|---|---|
| 5-FU | 129.0 | 12.6 |
| 50 pg/ul | 41.8* | 14.0 |
| Minoxidil | 210 | 20.5 |
| 10 pg/ul | 193* | 12.8 |
| Taurocholic | 514 | 16.0 |
| 50 pg/ul | 80* | 14.1 |
| Reserpine | 609 | 15.8 |
| 10 pg/ul | 195* | 10.2 |

For the comments of a, b, and *, see table 2.

If one assumes 100% ionization efficiency (i.e. complete conversion of solution species to gas phase ions) the present results indicate that the overall detection efficiencies are about 3% for two different seven capillary inlets. When we consider the transmission efficiency of the analyzing quadrupole is about 30% at the selected resolution, the ion transmission efficiency of the multi-capillary inlet and ion funnel interface can be estimated to be about 10%. Since this estimate is based upon the assumption of 100% ionization efficiency and operation at a relatively large flow rate where this is unlikely, it is apparent that the overall efficiency of the interface is considerably better than 10%.

Figure 4:
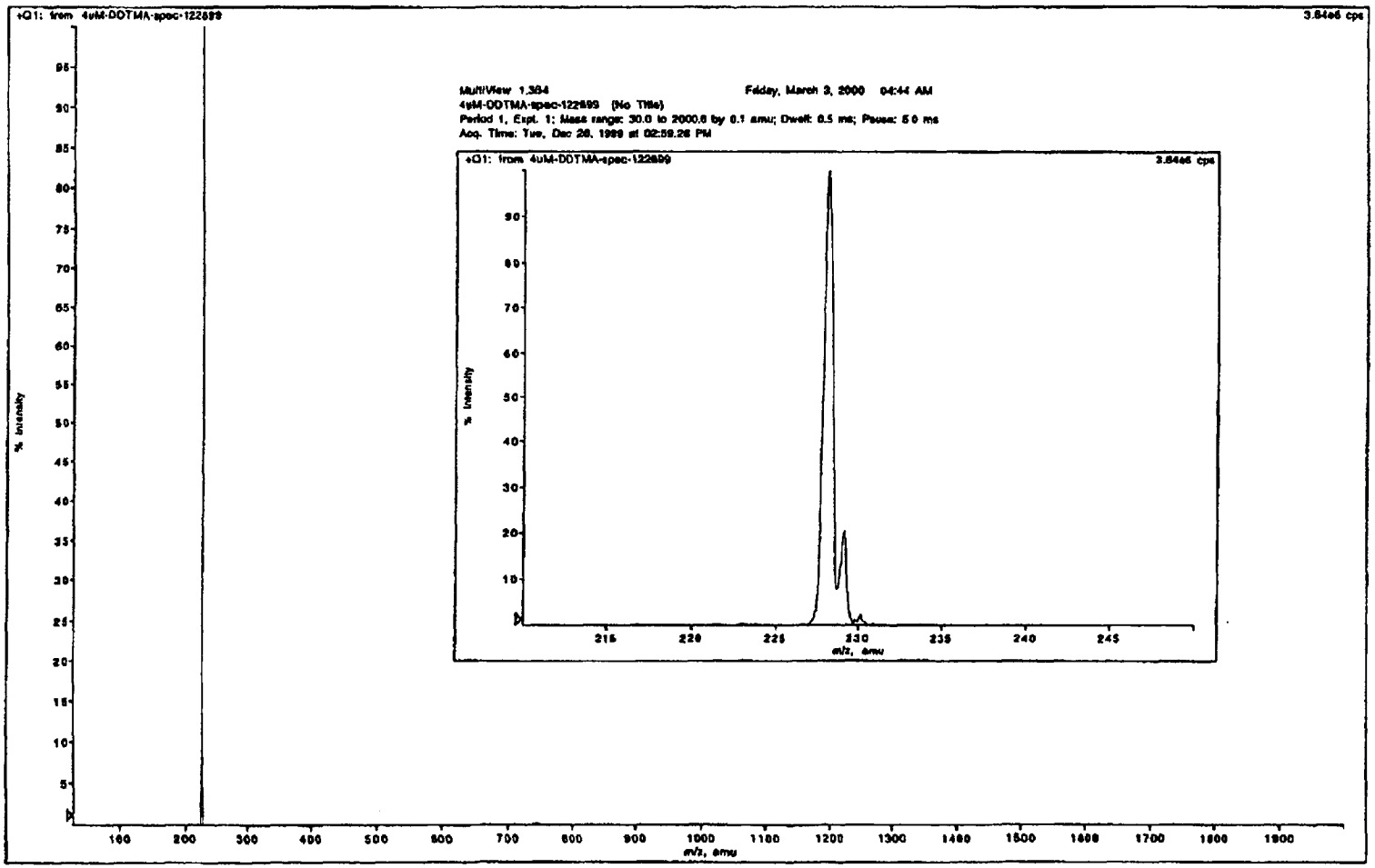
FIG. 4 is a spectrum for the 4.0 $\mu$M DDTMA solution obtained using a 0.51 mm I.D. seven capillary inlet with the ion funnel interface described in the experiments conducted to demonstrate a preferred embodiment of the present invention.

Mass spectrometric detection allows us to evaluate the composition of the transmitted ion current and the resolution of analyzing quadrupole. FIG. 4 shows a spectrum for the 4.0 $\mu$M DDTMA solution obtained using a 0.51 mm I.D. seven capillary inlet with the ion funnel interface. In this experiment, the electrospray emitter was intentionally positioned at off axis to protect the MS detector from degradation by a high ion current. The spectrum that shows 1 u resolution is dominated by the isotopic peaks of DDTMA and otherwise shows only very minor peaks due to impurities. This confirms that the current to the analyzing quadrupole (measured on IQ1) was primarily constituted of by analyte-related ions.

To study the detection efficiency for lower ion currents, mass spectra using a much more dilute 4.0 nM DDTMA solution with similar condition for the experiments of high concentrated sample were evaluated. To avoid possible contamination from the sample transfer line and electrospray emitter by the previous 4.0 uM DDTMA sample, all sample handling components (i.e. transfer line and emitter) were replaced for these experiments, and performance verified using a "blank" sample and by the absences of a peak at m/z 228.3 u. FIG. 5 shows the spectrum obtained for a 4.0 nM DDTMA sample using a 3.0 uL/min infusion rate. Based upon the analyte molecular infusion rate ($1.2\times10^8$ molecules/sec) and the sum of detected signals (ion count rates) for two isotopic peaks ($3.5\times10^6$ cps), the overall detection efficiency was 2.9%. When we consider the extended beam path (Q2 and Q3) in the spectrum measurement with low concentration sample, this detection efficiency is in a good agreement with that obtained by ion current measurements using higher concentration samples (3.5±0.2%). These results verify the high efficiency of the present interface and clearly indicate the direction of efforts for further improvements.

CLOSURE

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A method for introducing charged particles into a device comprising the steps of:

a) generating ions in a relatively high pressure region external to the device and proximate to a plurality of apertures extending into the device, and b) providing the interior of said device at a relatively low pressure, thereby causing the ions to move through the plurality of apertures and into the device, c) providing an ion funnel to receive ions at the interior of the device and adjacent to the plurality of apertures.

2. The method of claim 1 wherein the device is provided as a mass spectrometer.

3. The method of claim 1 wherein said relatively high pressure region is at between $10^{-1}$ millibar and 1 bar.

4. The method of claim 1 wherein the plurality of apertures are provided as six apertures formed in a circle about a seventh aperture.

5. The method of claim 1 wherein the plurality of apertures are provided as six capillaries formed in a circle about a seventh capillary.

6. The method of claim 5 wherein the capillaries are provided as stainless steel.

7. The method of claim 6 wherein the stainless steel capillaries are provided as extending through a stainless steel heating block.

8. The method of claim 7 wherein the stainless steel heating block is maintained at a temperature between 100° C. and 350° C.

9. The method of claim 7 wherein the stainless steel heating block is maintained at a temperature of about 200° C.

10. The method of claim 1 wherein the charged particles are generated with an electrospray ion source.

11. An apparatus for introducing charged particles generated at a relatively high pressure region into a device whose interior is maintained at a relatively low pressure region comprising a plurality of apertures extending into the device and an ion funnel to receive ions at the interior of the device and adjacent to the plurality of apertures, whereby charged particles generated in the relatively high pressure region move first through the plurality of apertures and then through the ion funnel.

12. The apparatus of claim 11 wherein the device is a mass spectrometer.

13. The apparatus of claim 11 wherein said relatively high pressure region is at between $10^{-1}$ millibar and 1 bar.

14. The apparatus of claim 11 wherein the plurality of apertures are six apertures formed in a circle about a seventh aperture.

15. The apparatus of claim 11 wherein the plurality of apertures are six capillaries formed in a circle about a seventh capillary.

16. The apparatus of claim 15 wherein the capillaries are stainless steel.

17. The apparatus of claim 16 wherein the stainless steel capillaries extend through a stainless steel heating block.

18. The apparatus of claim 11 further comprising an electrospray ion source interfaced with the plurality of apertures.

* * * * *